United States Patent [19]

Campbell et al.

[11] Patent Number: 4,670,001

[45] Date of Patent: Jun. 2, 1987

[54] BOTTOM STACKING TRAY

[76] Inventors: Joseph I. Campbell, 55 Valecrest Dr., Islington, Ontario, Canada, M9A 4P5; William T. Lombardi, 4697 Borina Dr., San Jose, Calif. 95129

[21] Appl. No.: 808,541

[22] Filed: Dec. 13, 1985

[51] Int. Cl.[4] ..... B65H 45/101

[52] U.S. Cl. ..... 493/413; 493/411; 493/441

[58] Field of Search ..... 493/411, 414, 415, 441, 493/413

[56] References Cited

U.S. PATENT DOCUMENTS

| | | | |
|---|---|---|---|
| 3,945,546 | 3/1976 | Balandis | 493/415 |
| 4,493,689 | 1/1985 | Affupper | 493/415 |
| 4,573,670 | 3/1986 | Felix | 493/413 |

FOREIGN PATENT DOCUMENTS

| | | | |
|---|---|---|---|
| 1141610 | 12/1902 | Fed. Rep. of Germany | 493/411 |

*Primary Examiner*—Frederick R. Schmidt
*Assistant Examiner*—William E. Terrell
*Attorney, Agent, or Firm*—Stevens, Davis, Miller & Mosher

[57] ABSTRACT

An apparatus for bottom folding and stacking of continuous strip of pre-folded paper is disclosed in which a reciprocating frame having a pair of belts defining a gap therebetween is reciprocated within a stationary frame beneath a pair of spaced-apart edge guides. Each belt is supported on a set of transverse rollers journalled in the inner frame and is preferably affixed at both ends to its respective edge guide.

Pre-folded paper strip continuously fed from a printer is drawn upwardly through the gap as the gap is reciprocated between the edge guides and is folded and stacked at the bottom of the stack, thereby allowing paper first printed to be inspected or removed without disturbing the stack.

5 Claims, 6 Drawing Figures

FIG.1.
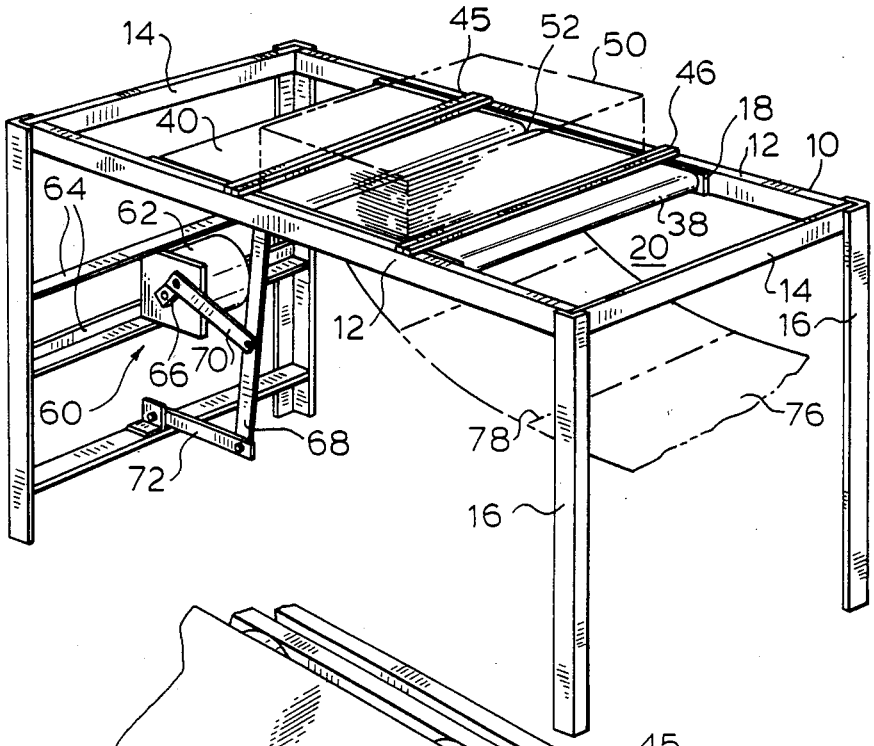
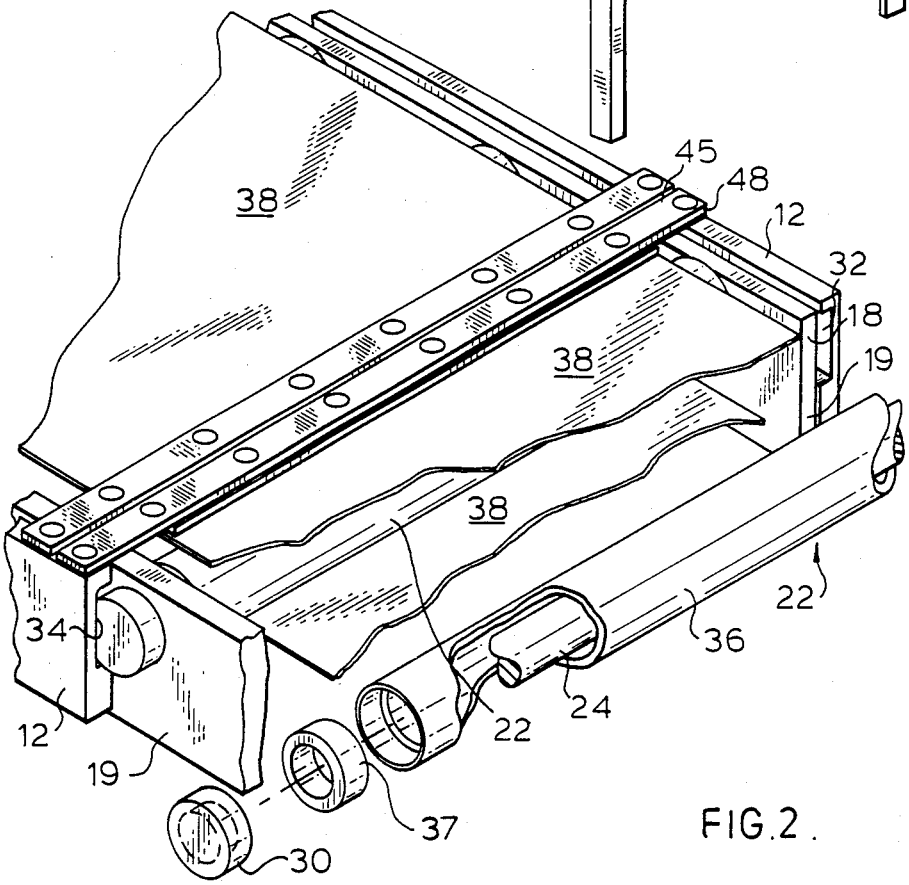
FIG.2.

BOTTOM STACKING TRAY

BACKGROUND OF THE INVENTION

This invention relates to a paper stacker and, more particularly, relates to a paper stacker for bottom folding and stacking paper.

Paper continuously stacked from printers, such as printers operated by computers and the like word processing equipment, normally is fed from the top onto an existing stack of folded paper. If it is desired to remove or read paper first printed, as is usually the case, it is necessary to disturb the whole stack of paper or to tear off the most recently printed paper for access to paper at the bottom of the stack.

STATEMENT OF INVENTION

The present invention provides a paper stacker apparatus which folds and stacks paper, fed continuously from a printer, from the bottom up. More particularly, the apparatus of the invention for continuously bottom stacking a strip of articulated pages of pre-folded paper comprises a stationary frame having an elongated rectangular opening therein; an inner frame adapted to reciprocate longitudinally within the stationary frame opening, said inner frame having two sets of a plurality of spaced-apart transverse rollers journalled therein for reciprocal travel therewith, adjacent rollers of the two sets of rollers defining a gap therebetween; a pair of spaced apart edge guides fixed transversely to the stationary frame defining a distance therebetween equal to the page length of the paper to be stacked; a belt affixed at one end to each of said edge guides and passing downwardly through the said gap; and a drive mechanism for reciprocating said inner frame and two sets of rollers within the rectangular opening such that the gap reciprocates between the edge guides whereby paper projecting through the said gap between the two sets of rolls is delivered upwardly onto the opposed belts and stacked between the edge guides.

The belts preferably are wrapped about the respective sets of rollers and are affixed at both ends to their respective edge guides.

The drive mechanism preferably comprises a pitman pivotally connected at one end to the inner reciprocal frame and at the other end to the stationary frame, and a rod connected to said pitman at one end and to the crank of a rotary motor at the other end, whereby rotary motion of the motor is converted to linear reciprocal motion of the inner frame connected thereto.

It is a principal object of the present invention, therefore, to provide an apparatus for the bottom folding and stacking of paper.

It is a further object of the present invention to provide an apparatus which is simple in construction and operation and which will continuously bottom fold and stack paper, particularly paper fed continuously as prefolded strip from a printer.

The foregoing and other objects of the invention and the manner in which they can be attained will become apparent from the following detailed description of the drawings, in which:

FIG. 1 is a perspective view of the bottom stacker of the invention depicting paper stacked thereon from a continuous feed;

FIG. 2 is a fragmentary view of the stacker of the invention showing an edge guide and a perspective view of a guide roller, partially cut-away and axially separated;

DESCRIPTION OF A PREFERRED EMBODIMENT OF THE INVENTION

Figure 3:
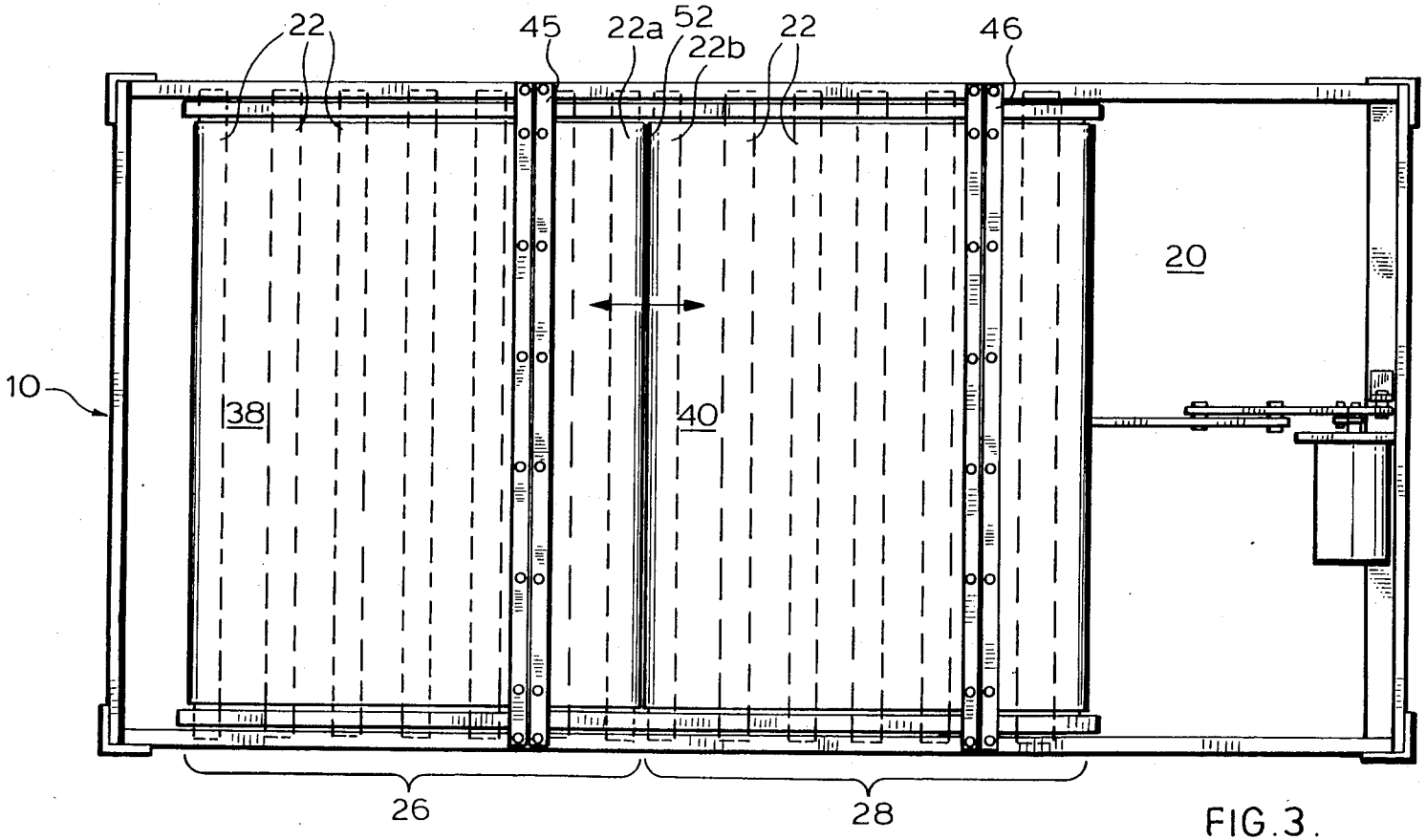
FIG. 3 is a top plan view of the stacker.
Figure 4:
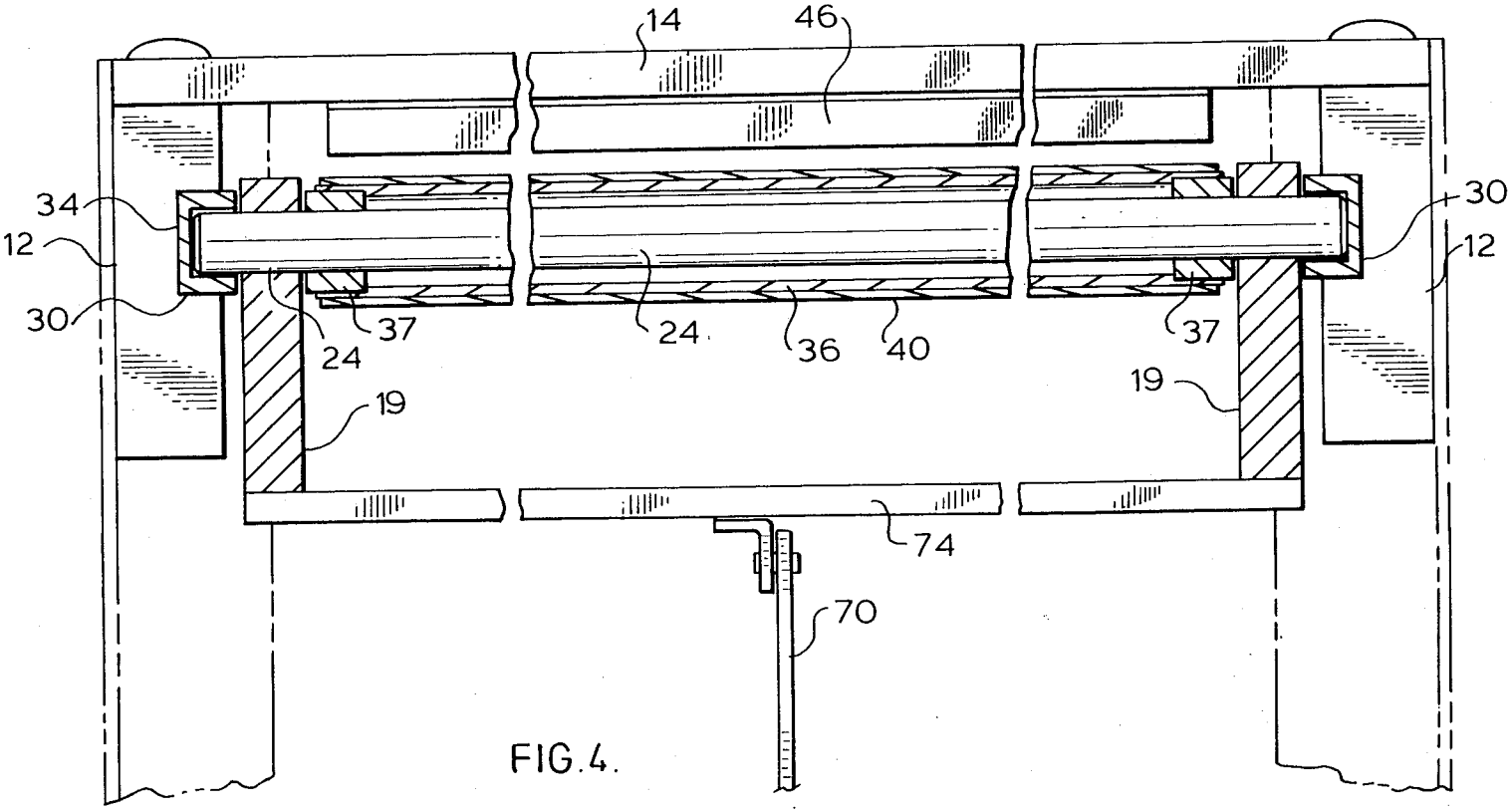
FIG. 4 is an end elevation of the stacker taken from the right as viewed in FIG. 3.

With reference now to FIG. 1, the bottom stacker of the invention comprises a stationary frame 10 having longitudinal side members 12 and transverse end members 14 secured together such as by bolting or welding with vertical legs 16 affixed to each corner to support frame 10 at a convenient height for use by operators. Turning now to FIGS. 2–4, a inner frame 18 consisting of a pair of spaced-apart side members 19 is mounted within opening 20 defined by stationary frame.10 and is journalled for reciprocal longitudinal travel therein by means of a plurality of rollers 22 in each of sets 26, 28 of said rollers.

Each set of rollers 26, 28 comprises the plurality of equispaced rollers 22 having shafts 24 journalled in holes 24 in side frame members 19. End caps 30 mounted at each end of shafts 24 are journalled thereon for free rotational movement and are adapted to roll within opposed recesses 32, 34 formed in the inner faces of stationary side frame members 12. Inner frame 18 thus is free to reciprocate longitudinally within opening 20 of stationary frame 10. Each of rollers 22 has a sleeve 36 mounted on roller bearing 37 for independent rotation of sleeves 36 regardless of the direction of rotation of shafts 32.

Figure 5:
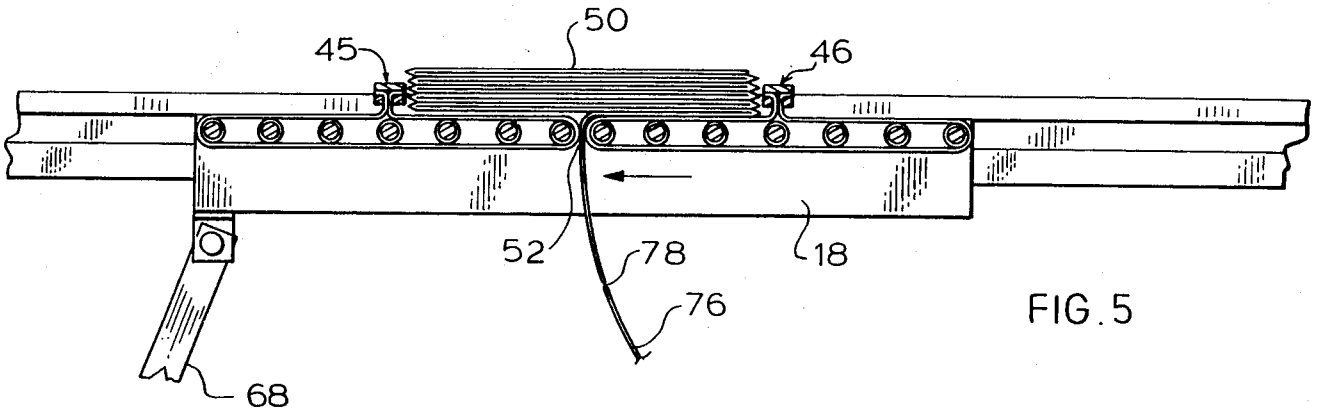
FIG. 5 is a side elevation, partly cut away, of the stacker of the invention at the centre of travel of the drive mechanism.
Figure 6:
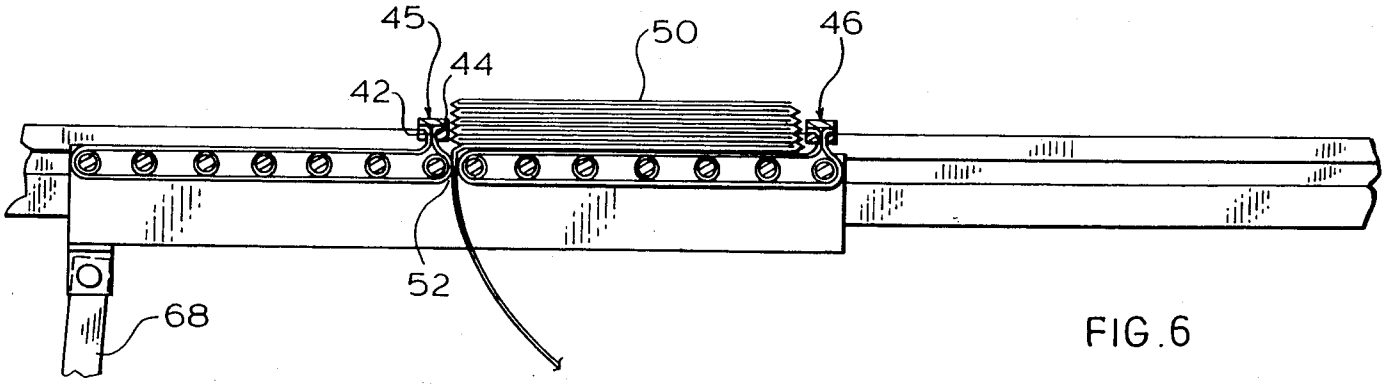
FIG. 6 is a side elevation corresponding to FIG. 5 in which the drive mechanism has completed its travel to the left.

Each set 26, 28 of rollers 22 is shown to have a belt 38, 40 wrapped thereabout. With particular reference now to FIGS. 5 and 6, and to FIG. 2, the opposite ends 42, 44 of belt 38, which is typical of both belts, are secured to transverse edge guide 46 which is secured to side rail members 12 of stationary frame 10. Edge guide 46 may be comprised of a pair of transverse members 48 rivetted or preferably screwed to members 12. Edge guides are spaced apart a distance substantially equal to the length of a page of folded paper stacked on the apparatus. In operation, the adjacent ends of belts 38, 40 affixed to respective edge guides 45, 46 will remain stationary, as well as the upper exposed surfaces of the belts relative to the paper stack 50 thereon, but the gap 52 defined between opposing roller *22a, 22b* of the two sets 38, 40 of rollers will reciprocate between the edge guides 45, 46 as the inner frame 18 is reciprocated longitudinally.

Although belts 38, 40 are each connected at both ends to a respective edge guide, it will be understood that the ends of belts 38, 40 passing down through gap 52 may be wrapped about take-up rollers, not shown, to maintain a light tension on each of belts 38, 40 as the inner frame 18 is reciprocated.

With reference now to FIGS. 1 and 4–6, the drive mechanism 60 may comprise a rotary, fixed or variable speed motor 62 rigidly secured to cross-members 64 of stationary frame 10 at one end thereof with a crank 66 pivotally connected to pitman 68 by rod 70. Pitman 68 is pivotally secured to stationary frame 12 by link 72 and is pivotally connected to transverse member 74 which is rigidly secured to inner frame 18. The rotary travel of crank 66 of motor 62 thus is converted to the horizontal reciprocal travel of inner frame 18 within stationary frame 12 with an amplitude equal to the spacing between edge guides 45, 46.

Turning now to FIG. 5, it will be seen that continuous paper 76 having page fold lines 78 will be drawn upwardly through gap 52 as inner frame 18 moves to the left until the end of travel is reached, as shown in FIG. 6, at which time inner frame 18 will reciprocate to the right to deliver the next sheet of paper to the bottom of stack 50. Stack 50 will thus be fed from below with paper first fed to the stacker positioned at the top of the stack.

The present invention provides a number of important advantagages. Pre-folded paper fed as a continuous strip from a printer can be easily stacked from the bottom up, thereby giving ready access to and removal of paper first printed. The page size of paper accommodated on the stacker can be readily varied by changing the horizontal spacing of edge guides 45, 46 and by changing the effective length of connecting rod 70 such that gap 52 will reciprocate between the said edge guides.

It will be understood, of course, that modifications can be made in the embodiment of the invention illustrated and described herein without departing from the scope and purview of the invention as defined by the appended claims.

What I claim as new and desire to protect by Letters Patent of the United States is:

1. A bottom stacking apparatus for continually folding and stacking pages of continuous paper comprising, in combination, a stationary frame having an elongated rectangular opening therein, an inner frame adapted to reciprocate longitudinally within the stationary frame opening, said inner frame having two opposed sets of a plurality of spaced-apart transverse rollers journalled therein for reciprocal travel therewith, adjacent rollers of the two sets of rollers defining a gap therebetween, an edge guide fixed transversely to the stationary frame above each set of rollers, said edge guides defining therebetween a distance equal to the length of pages of the paper to be stacked; a belt wrapped about each set of rollers and affixed at both ends to a respective edge guide and, a drive mechanism operatively connected to the inner frame for reciprocating said inner frame within the rectangular opening such that the gap reciprocates between the edge guides whereby paper projecting through the said gap between the two sets of roller is delivered upwardly onto the opposed belts and stacked between the edge guides.

2. A bottom stacking apparatus as claimed in claim 1 in which said two sets of rollers are planar and extend longitudinally not more than one-half of the length of the rectangular opening.

3. A bottom stacking apparatus as claimed in claim 2 in which said drive mechanism comprises a rotary motor having a crank and a pitman operatively connected to said crank by a connecting rod for conversion of rotary motion of the motor to reciprocal motion of the inner frame a distance equal to the spacing of the edge guides.

4. A bottom stacking apparatus as claimed in claim 3 in which each of said rollers comprises a transverse shaft journalled for rotary motion in a pair of spaced-apart longitudinal members of the inner frame with end portions of said shaft projecting beyond said longitudinal members, an end cap rotatably affixed to said projecting ends of said shaft for reciprocal travel in recesses formed in the stationary frame, and a sleeve rotatably mounted on said shaft between said longitudinal members for independent rotation thereon.

5. A bottom stacking apparatus as claimed in claim 2 in which each of said rollers comprises a transverse shaft journalled for rotary motion in a pair of spaced-apart longitudinal members of the inner frame with end portions of said shaft projecting beyond said longitudinal members, an end cap rotatably affixed to said projecting ends of said shaft for reciprocal travel in recesses formed in the stationary frame, and a sleeve rotatably mounted on said shaft between said longitudinal members for independent rotation thereon.

* * * * *